US006117310A

United States Patent [19]

Rivers

[11] Patent Number: 6,117,310

[45] **Date of Patent: *Sep. 12, 2000**

[54] PROCESS FOR TREATING A HYDROCARBON SUBSTRATE WITH A BISOXAZOLIDINE HYDROGEN SULFIDE SCAVENGER

[75] Inventor: Gordon T. Rivers, Houston, Tex.

[73] Assignee: Baker Hughes Incorporated, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/970,669

[22] Filed: Nov. 14, 1997

Related U.S. Application Data

[63] Continuation of application No. 08/679,040, Jul. 12, 1996, abandoned.

[51] Int. Cl.[7] ..... C10G 29/20

[52] U.S. Cl. ..... 208/236; 585/860

[58] Field of Search ..... 208/236; 585/860

[56] References Cited

U.S. PATENT DOCUMENTS

| | | | |
|---|---|---|---|
| 4,978,512 | 12/1990 | Dillon | 423/226 |
| 5,347,003 | 9/1994 | Trauffer et al. | 544/8 |
| 5,354,453 | 10/1994 | Bhatia | 208/236 |
| 5,488,103 | 1/1996 | Gatlin | 536/55.2 |

FOREIGN PATENT DOCUMENTS 22290542 3/1996 United Kingdom .

*Primary Examiner*—Walter D. Griffin
*Assistant Examiner*—Nadine Preisch
*Attorney, Agent, or Firm*—Paula D. Morris & Asociates P.C.

[57] ABSTRACT

The present invention provides a method for scavenging sulfhydryl compounds from sour hydrocarbon substrates, preferably crude oils, refined distillate streams, and natural gas, by mixing the substrates with preferably substantially water free bisoxazolidines.

18 Claims, 7 Drawing Sheets

| NAME | BOTTLE NUMBER | DOSAGE (ppm) | TIME DISP (Hours) | H2S (ppm) | EFFECT RATIO | % H2S VARIANCE |
|---|---|---|---|---|---|---|
| BLANK | A-0 | 0 | 20.25 | 4,233 | NA | -6.0% |
| BLANK | A-0 | 0 | 25.00 | 4,471 | NA | -0.7% |
| BLANK | A-0 | 0 | 39.75 | 4,720 | NA | 4.9% |
| BLANK | A-0 | 0 | 44.50 | 5,180 | NA | 15.1% |
| BLANK | A-0 | 0 | 48.50 | 4,583 | NA | 1.8% |
| BLANK | A-0 | 0 | 65.25 | 3,822 | NA | -15.1% |
| | | | AVERAGE | 4,502 | | |

| NAME | BOTTLE NUMBER | DOSAGE (ppm) | TIME DISP (Hours) | H2S (ppm) | EFFECT RATIO | % H2S ABATED |
|---|---|---|---|---|---|---|
| A | A-1 | 0 | 20.25 | 6,083 | | |
| A | A-1 | 150 | 25.00 | 8,237 | -14.36 | -35.4% |
| A | A-1 | 150 | 39.75 | 6,903 | -5.47 | -13.5% |
| A | A-1 | 250 | 44.50 | 5,400 | 2.73 | 11.2% |
| A | A-1 | 350 | 48.00 | 2,457 | 10.36 | 59.6% |
| A | A-1 | 350 | 65.25 | 2,243 | 10.97 | 63.1% |
| | | | | | | |
| B | A-2 | 0 | 20.25 | 5,414 | | |
| B | A-2 | 150 | 25.00 | 7,321 | -12.71 | -35.2% |
| B | A-2 | 150 | 39.75 | 5,392 | 0.15 | 0.4% |
| B | A-2 | 250 | 44.50 | 4,564 | 3.40 | 15.7% |
| B | A-2 | 350 | 48.50 | 2,854 | 7.31 | 47.3% |
| B | A-2 | 350 | 65.25 | 1,656 | 10.74 | 69.4% |
| | | | | | | |
| RE-3019 | A-3 | 0 | 20.25 | 8,620 | | |
| RE-3019 | A-3 | 150 | 25.00 | 8,095 | 3.50 | 6.1% |
| RE-3019 | A-3 | 150 | 39.75 | 3,531 | 33.93 | 59.0% |
| RE-3019 | A-3 | 250 | 44.50 | 2,369 | 25.00 | 72.5% |
| RE-3019 | A-3 | 350 | 48.50 | 896 | 22.07 | 89.6% |
| RE-3019 | A-3 | 350 | 65.25 | 371 | 23.57 | 95.7% |

FIG. 1

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-4 | 0 | 20.25 | 7,818 | | |
| RE-3175 | A-4 | 150 | 25.00 | 3,859 | 26.39 | 50.6% |
| RE-3175 | A-4 | 150 | 39.75 | 2,498 | 35.47 | 68.0% |
| RE-3175 | A-4 | 250 | 44.50 | 1,885 | 23.73 | 75.9% |
| RE-3175 | A-4 | 350 | 48.50 | 1,157 | 19.03 | 85.2% |
| RE-3175 | A-4 | 350 | 65.25 | 783 | 20.10 | 90.0% |
| | | | | | | |
| A | A-5 | 0 | 20.25 | 9,166 | | |
| A | A-5 | 150 | 25.00 | 10,497 | -8.87 | -14.5% |
| A | A-5 | 150 | 39.75 | 9,208 | -0.28 | -0.5% |
| A | A-5 | 250 | 44.50 | 8,258 | 3.63 | 9.9% |
| A | A-5 | 350 | 48.50 | 5,890 | 9.36 | 35.7% |
| A | A-5 | 350 | 65.25 | 4,453 | 13.47 | 51.4% |
| | | | | | | |
| B | A-6 | 0 | 20.25 | 8,504 | | |
| B | A-6 | 150 | 25.00 | 9,015 | -3.41 | -6.0% |
| B | A-6 | 150 | 39.75 | 7,628 | 5.84 | 10.3% |
| B | A-6 | 250 | 44.50 | 6,239 | 9.06 | 26.6% |
| B | A-6 | 350 | 48.50 | 4,269 | 12.10 | 49.8% |
| B | A-6 | 350 | 65.25 | 2,867 | 16.11 | 66.3% |
| | | | | | | |
| RE-3019 | A-7 | 0 | 20.25 | 7,988 | | |
| RE-3019 | A-7 | 150 | 25.00 | 7,786 | 1.35 | 2.5% |
| RE-3019 | A-7 | 150 | 39.75 | 3,538 | 29.67 | 55.7% |
| RE-3019 | A-7 | 250 | 44.50 | 2,129 | 23.44 | 73.3% |
| RE-3019 | A-7 | 350 | 48.50 | 770 | 20.62 | 90.4% |
| RE-3019 | A-7 | 350 | 65.25 | 398 | 21.69 | 95.0% |

FIG. 1
(Continued)

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-8 | 0 | 20.25 | 8,612 | | |
| RE-3175 | A-8 | 150 | 25.00 | 6,340 | 15.15 | 25.4% |
| RE-3175 | A-8 | 150 | 39.75 | 2,847 | 38.43 | 66.9% |
| RE-3175 | A-8 | 250 | 44.50 | 1,787 | 27.30 | 79.2% |
| RE-3175 | A-8 | 350 | 48.50 | 514 | 23.14 | 94.0% |
| RE-3175 | A-8 | 350 | 65.25 | 594 | 22.91 | 93.1% |
| | | | | | | |
| BLANK | A-9 | 0 | 20.25 | 7,100 | NA | -7.6% |
| BLANK | A-9 | 0 | 25.00 | 8,189 | NA | 6.5% |
| BLANK | A-9 | 0 | 39.75 | 7,559 | NA | -1.7% |
| BLANK | A-9 | 0 | 44.50 | 7,516 | NA | -2.2% |
| BLANK | A-9 | 0 | 48.50 | 7,577 | NA | -1.4% |
| BLANK | A-9 | 0 | 65.25 | 8,180 | NA | 6.4% |
| | | | AVERAGE | 7,687 | | |
| | | | | | | |
| BLANK | A-10 | 0 | 20.25 | 10,876 | | |
| BLANK | A-10 | 0 | 25.00 | 12,163 | NA | -11.8% |
| BLANK | A-10 | 0 | 39.75 | 10,203 | NA | 6.2% |
| RE-3019 | A-10 | 169 | 44.50 | 6,340 | 26.84 | 41.7% |
| RE-3019 | A-10 | 350 | 48.50 | 1,510 | 26.76 | 86.1% |
| RE-3019 | A-10 | 350 | 65.25 | 247 | 30.37 | 97.7% |

| ADDITIVE NAME | FINAL COST* $/MB | EFFECT RATIO (T.E.R.) | INITIAL H2S (ppm) | FINAL H2S (ppm) | ADDITIVE STD COST $/LB | ADDITIVE DENSITY gm/ml |
|---|---|---|---|---|---|---|
| A | 18.04 | 10.97 | 6083 | 2243 | 0.4634 | 1.2200 |
| B | 46.08 | 10.74 | 5414 | 1656 | 1.2734 | 1.1100 |
| RE-3019 | 19.47 | 23.57 | 8620 | 371 | 1.1300 | 1.1600 |
| RE-3175 | 22.35 | 20.10 | 7818 | 783 | 0.9650 | 1.3300 |
| A | 14.70 | 13.47 | 9166 | 4453 | 0.4634 | 1.2200 |
| B | 30.72 | 16.11 | 8504 | 2867 | 1.2734 | 1.1100 |
| RE-3019 | 21.16 | 21.69 | 7988 | 398 | 1.1300 | 1.1600 |
| RE-3175 | 19.61 | 22.91 | 8612 | 594 | 0.9650 | 1.3300 |
| RE-3019 | 15.11 | 30.37 | 10876 | 247 | 1.1300 | 1.1600 |

FIG. 1
(Continued)

| NAME | BOTTLE NUMBER | DOSAGE (ppm) | TIME DISP (Hours) | H2S (ppm) | EFFECT RATIO | % H2S VARIANCE |
|---|---|---|---|---|---|---|
| BLANK | A-0 | 0 | 24.50 | 17,539 | NA | -14.6% |
| BLANK | A-0 | 0 | 27.25 | 23,026 | NA | 12.1% |
| BLANK | A-0 | 0 | 44.75 | 22,257 | NA | 8.4% |
| BLANK | A-0 | 0 | 50.83 | 22,016 | NA | 7.2% |
| BLANK | A-0 | 0 | 69.25 | 21,710 | NA | 5.7% |
| BLANK | A-0 | 0 | 74.42 | 21,251 | NA | 3.5% |
| BLANK | A-0 | 0 | 147.42 | 15,990 | NA | -22.2% |
| | | | AVERAGE | 20,541 | | |

| NAME | BOTTLE NUMBER | DOSAGE (ppm) | TIME DISP (Hours) | H2S (ppm) | EFFECT RATIO | % H2S ABATED |
|---|---|---|---|---|---|---|
| A | A-1 | 0 | 24.50 | 29,339 | | |
| A | A-1 | 250 | 27.25 | 27,732 | 6.43 | 5.5% |
| A | A-1 | 250 | 44.75 | 27,394 | 7.78 | 6.6% |
| A | A-1 | 400 | 50.83 | 25,016 | 10.81 | 14.7% |
| A | A-1 | 400 | 69.25 | 26,061 | 8.20 | 11.2% |
| A | A-1 | 600 | 74.42 | 22,398 | 11.57 | 23.7% |
| A | A-1 | 600 | 147.42 | 24,498 | 8.07 | 16.5 |
| | | | | | | |
| B | A-2 | 0 | 24.50 | 36,936 | | |
| B | A-2 | 250 | 27.25 | 38,692 | -7.02 | -4.8% |
| B | A-2 | 250 | 44.75 | 29,378 | 30.23 | 20.5% |
| B | A-2 | 400 | 50.83 | 25,972 | 27.41 | 29.7% |
| B | A-2 | 400 | 69.25 | 20,992 | 39.86 | 43.2% |
| B | A-2 | 600 | 74.42 | 18,230 | 31.18 | 50.6% |
| B | A-2 | 600 | 147.42 | 15,157 | 36.30 | 59.0% |
| | | | | | | |
| RE-3019 | A-3 | 0 | 24.50 | 30,579 | | |
| RE-3019 | A-3 | 250 | 27.25 | 28,326 | 9.01 | 7.4% |
| RE-3019 | A-3 | 250 | 44.75 | 16,788 | 55.16 | 45.1% |
| RE-3019 | A-3 | 400 | 50.83 | 11,571 | 47.52 | 62.2% |
| RE-3019 | A-3 | 400 | 69.25 | 7,521 | 57.65 | 75.4% |
| RE-3019 | A-3 | 600 | 74.42 | 5,511 | 41.78 | 82.0% |
| RE-3019 | A-3 | 600 | 147.42 | 3,344 | 45.39 | 89.1% |

FIG. 3

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-4 | 0 | 24.50 | 23,399 | | |
| RE-3175 | A-4 | 250 | 27.25 | 22,314 | 4.34 | 4.6% |
| RE-3175 | A-4 | 250 | 44.75 | 14,029 | 37.48 | 40.0% |
| RE-3175 | A-4 | 400 | 50.83 | 12,410 | 27.47 | 47.0% |
| RE-3175 | A-4 | 400 | 69.25 | 11,015 | 30.96 | 52.9% |
| RE-3175 | A-4 | 600 | 74.42 | 8,807 | 24.32 | 62.4% |
| RE-3175 | A-4 | 600 | 147.42 | 8,903 | 24.16 | 62.0% |
| | | | | | | |
| A | A-5 | 0 | 24.50 | 29,567 | | |
| A | A-5 | 250 | 27.25 | 31,324 | -7.03 | -5.9% |
| A | A-5 | 250 | 44.75 | 28,591 | 3.90 | 3.3% |
| A | A-5 | 400 | 50.83 | 27,055 | 6.28 | 8.5% |
| A | A-5 | 400 | 69.25 | 27,621 | 4.87 | 6.6% |
| A | A-5 | 600 | 74.42 | 22,475 | 11.82 | 24.0% |
| A | A-5 | 600 | 147.42 | 24,199 | 8.95 | 18.2% |
| | | | | | | |
| B | A-6 | 0 | 24.50 | 33,206 | | |
| B | A-6 | 250 | 27.25 | 31,889 | 5.27 | 4.0% |
| B | A-6 | 250 | 44.75 | 20,747 | 49.84 | 37.5% |
| B | A-6 | 400 | 50.83 | 19,338 | 34.67 | 41.8% |
| B | A-6 | 400 | 69.25 | 15,756 | 43.63 | 52.6% |
| B | A-6 | 600 | 74.42 | 11,983 | 35.37 | 63.9% |
| B | A-6 | 600 | 147.42 | 11,370 | 36.39 | 65.8% |
| | | | | | | |
| RE-3019 | A-7 | 0 | 24.50 | 32,899 | | |
| RE-3019 | A-7 | 250 | 27.25 | 26,098 | 27.20 | 20.7% |
| RE-3019 | A-7 | 250 | 44.75 | 13,391 | 78.03 | 59.3% |
| RE-3019 | A-7 | 400 | 50.83 | 9,399 | 58.75 | 71.4% |
| RE-3019 | A-7 | 400 | 69.25 | 6,606 | 65.73 | 79.9% |
| RE-3019 | A-7 | 600 | 74.42 | 3,460 | 49.07 | 89.5% |
| RE-3019 | A-7 | 600 | 147.42 | 2,549 | 50.58 | 92.3% |

FIG. 3
(Continued)

| NAME | BOTTLE NUMBER | DOSAGE (ppm) | TIME DISP (Hours) | H2S (ppm) | EFFECT RATIO | % H2S ABATED |
|---|---|---|---|---|---|---|
| RE-3175 | A-8 | 0 | 24.50 | 33,183 | | |
| RE-3175 | A-8 | 250 | 27.25 | 24,049 | 36.54 | 27.5% |
| RE-3175 | A-8 | 250 | 44.75 | 10,856 | 89.31 | 67.3% |
| RE-3175 | A-8 | 400 | 50.83 | 9,507 | 59.19 | 71.3% |
| RE-3175 | A-8 | 400 | 69.25 | 8,719 | 61.16 | 73.7% |
| RE-3175 | A-8 | 600 | 74.42 | 6,485 | 44.50 | 80.5% |
| RE-3175 | A-8 | 600 | 147.42 | 5,213 | 46.62 | 84.3% |
| | | | | | | |
| BLANK | A-9 | 0 | 24.50 | 33,645 | NA | -3.3% |
| BLANK | A-9 | 0 | 27.25 | 37,220 | NA | 7.0% |
| BLANK | A-9 | 0 | 44.75 | 36,630 | NA | 5.3% |
| BLANK | A-9 | 0 | 50.83 | 35,516 | NA | 2.1% |
| BLANK | A-9 | 0 | 69.25 | 36,865 | NA | 6.0% |
| BLANK | A-9 | 0 | 74.42 | 33,541 | NA | -3.6% |
| BLANK | A-9 | 0 | 147.42 | 30,069 | NA | -13.6% |
| | | | AVERAGE | 34,784 | | |
| BLANK | A-10 | 0 | 24.50 | 34,609 | | |
| BLANK | A-10 | 0 | 27.25 | 37,104 | NA | -7.2% |
| BLANK | A-10 | 0 | 44.75 | 36,438 | NA | -5.3% |
| A | A-10 | 400 | 50.83 | 29,426 | 12.96 | 15.0% |
| A | A-10 | 400 | 69.25 | 27,315 | 18.24 | 21.1% |
| A | A-10 | 600 | 74.42 | 23,390 | 18.70 | 32.4% |
| A | A-10 | 600 | 147.42 | 27,895 | 11.19 | 19.4% |

| | | TYPICAL TREATMENT COSTS | | | | |
|---|---|---|---|---|---|---|
| ADDITIVE NAME | FINAL COST* $/MB | EFFECT RATIO (T.E.R.) | INITIAL H2S (ppm) | FINAL H2S (ppm) | ADDITIVE STD COST $/LB | ADDITIVE DENSITY gm/ml |
| A | 20.42 | 8.07 | 29339 | 24498 | 0.4534 | 1.0380 |
| B | 11.93 | 36.30 | 36936 | 15157 | 1.2602 | 0.9820 |
| RE-3019 | 9.40 | 45.39 | 30579 | 3344 | 1.1310 | 1.0780 |
| RE-3175 | 13.48 | 24.16 | 23399 | 8903 | 0.8270 | 1.1250 |
| A | 18.82 | 8.95 | 29567 | 24199 | 0.4634 | 1.0380 |
| B | 11.90 | 36.39 | 33206 | 11370 | 1.2602 | 0.9820 |
| RE-3019 | 8.44 | 50.58 | 32899 | 2549 | 1.1310 | 1.0780 |
| RE-3175 | 6.99 | 46.62 | 33183 | 5213 | 0.8270 | 1.1250 |
| A | 14.72 | 11.19 | 34609 | 27895 | 0.4534 | 1.0380 |

FIG. 3
(Continued)

PROCESS FOR TREATING A HYDROCARBON SUBSTRATE WITH A BISOXAZOLIDINE HYDROGEN SULFIDE SCAVENGER

This is a continuation of application Ser. No. 08/679,040, filed Jul. 12, 1986, now abandoned.

FIELD OF THE INVENTION

The invention relates to chemical compositions and methods for scavenging sulfhydryl compounds, particularly hydrogen sulfide ($H_2S$), from "sour" aqueous and hydrocarbon substrates. More particularly, the invention relates to hydrocarbon soluble sulfhydryl scavengers comprising preferably substantially water free bisoxazolidines.

BACKGROUND OF THE INVENTION

The removal of $H_2S$ from a liquid or gaseous hydrocarbon stream is a problem that has challenged many workers in many industries. One such industry is the petroleum industry, where the $H_2S$ content of certain crudes from reservoirs in many areas of the world is too high for commercial acceptance. The same is true of many natural gas streams. Even where a crude or gas stream contains only a minor amount of sulfur, the processes to which the crude oil or fractions thereof are subjected often produce one or more hydrocarbon streams that contain $H_2S$.

The presence of $H_2S$ in hydrocarbon streams presents many environmental and safety hazards. Hydrogen sulfide is highly flammable, toxic when inhaled, and strongly irritates the eyes and other mucous membranes. In addition, sulfur-containing salts can deposit in and plug or corrode transmission pipes, valves, regulators, and the like. Flaring of natural gas that contains $H_2S$ does not solve the problem for gas streams because, unless the $H_2S$ is removed prior to flaring, the combustion products will contain unacceptable amounts of pollutants, such as sulfur dioxide ($SO_2$)—a component of "acid rain."

Hydrogen sulfide has an offensive odor, and natural gas containing $H_2S$ often is called "sour" gas. Treatments to reduce or remove $H_2S$ from hydrocarbon or other substrates often are called "sweetening" treatments. The agent that is used to remove or reduce $H_2S$ levels sometimes is called a "scavenging agent."

The problem of removing or reducing $H_2S$ from hydrocarbon substrates has been solved in many different ways in the past. Most of the known techniques involve either (a) absorption, or selective absorption by a suitable absorbent, after which the absorbent is separated and the sulfur removed to regenerate and recycle the absorbent, or (b) selective reaction with a reagent that produces a readily soluble product. A number of known systems treat a hydrocarbon stream with an amine, an aldehyde, an alcohol, and/or a reaction product thereof.

Previously known sulfhydryl scavengers theoretically may require about 2–3 ppm of scavenger per ppm of hydrogen sulfide; however, the amount actually required is much higher—in the range of about 5–10 or more ppm per ppm of hydrogen sulfide. A high amount of scavenger is required because of the difficulty of distributing the scavenger evenly throughout the fluid. Much of this difficulty is the result of inadequate solubility of the scavenger in the hydrocarbon substrate.

A continuing need exists for effective and efficient processes and compositions to reduce and/or remove sulfhydryl compounds from hydrocarbon substrates.

SUMMARY OF THE INVENTION

The present invention provides a method for scavenging sulfhydryl compounds from sour hydrocarbon substrates using bisoxazolidines.

BRIEF DESCRIPTION OF THE DRAWINGS

FIG. 1 is a Table giving the results of Example 2.

FIG. 3 is a Table giving the results of Example 3.

DETAILED DESCRIPTION OF THE INVENTION

Figure 2:
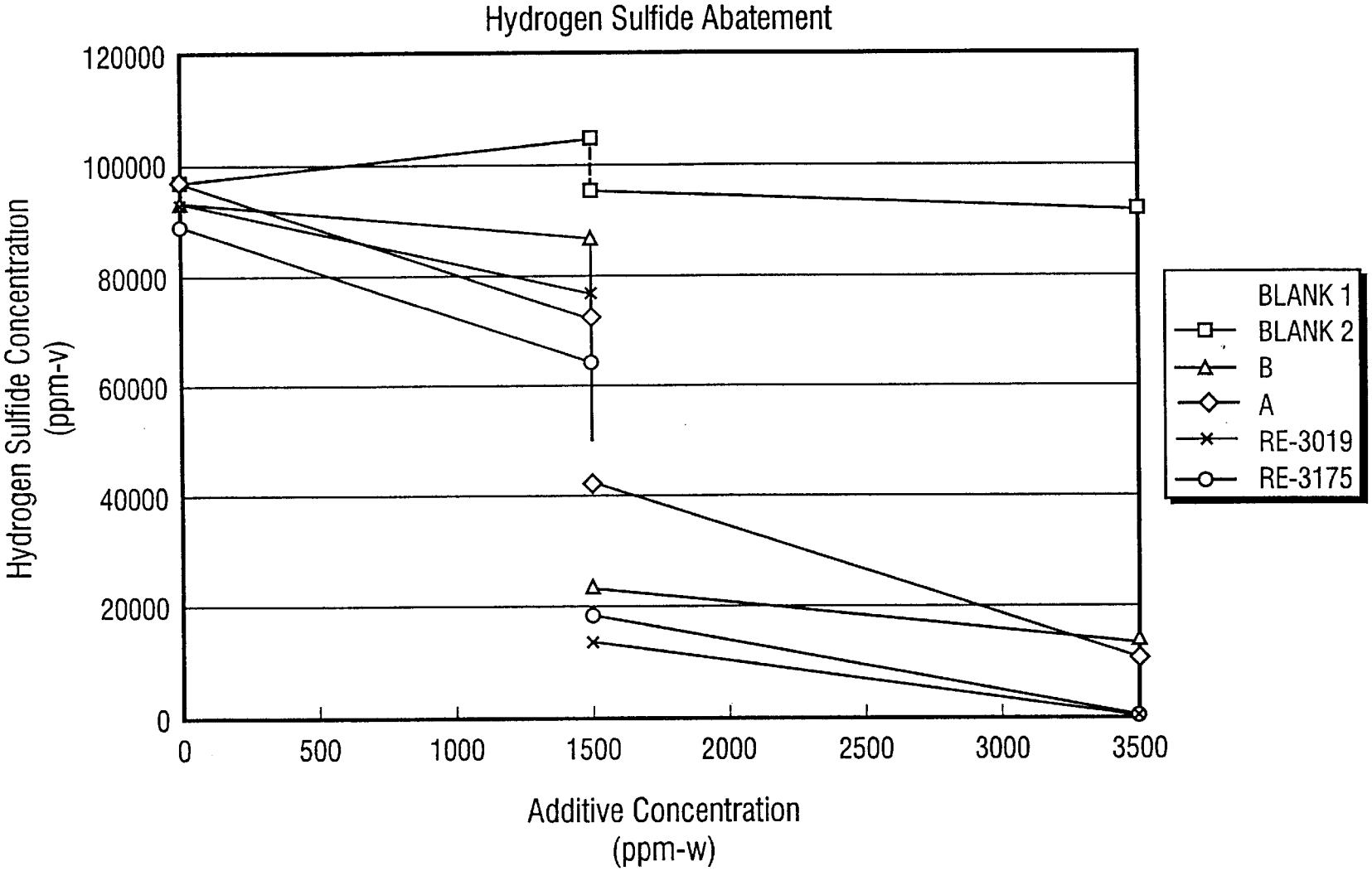
FIG. 2 is a chart of the results in FIG. 1.

The scavenging agents of the present invention may be used to treat hydrocarbon substrates that are rendered "sour" by the presence of "sulfhydryl compounds," such as hydrogen sulfide ($H_2S$), organosulfur compounds having a sulfhydryl (—SH) group, known as mercaptans, also known as thiols (R—SH, where R is a hydrocarbon group), thiol carboxylic acids (RCO—SH), dithio acids (RCS—SH), and related compounds.

A wide variety of hydrocarbon substrates can be treated using the scavenging agents of the present invention. The term "hydrocarbon substrate" is meant to include unrefined and refined hydrocarbon streams, including natural gas, derived from petroleum or from the liquefaction of coal, both of which contain hydrogen sulfide or other sulfur-containing compounds. Thus, particularly for petroleum-based substrates, the term "hydrocarbon substrate" includes wellhead condensate as well as crude oil which may be contained in storage facilities at the producing field. "Hydrocarbon substrate" also includes the same materials transported from those facilities by barges, pipelines, tankers, or trucks to refinery storage tanks, or, alternately, transported directly from the producing facilities through pipelines to the refinery storage tanks. The term "hydrocarbon substrate" also includes product streams found in a refinery, including distillates such as gasolines, distillate fuels, oils, and residual fuels. As used in the claims, the term "hydrocarbon substrate" also refers to vapors produced by the foregoing materials.

Preferred substrates for the bisoxazolidines of the present inventions are those in which the presence of water can be detrimental. Such substrates include, but are not necessarily limited to dry crude oils and fuels, such as natural gas, particularly dry natural gas condensates.

The scavenging agents of the present invention preferably have the following general formula:

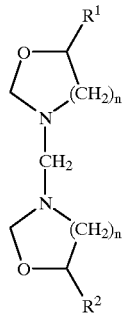

wherein n is between about 1–2 and $R^1$ and $R^2$ independently are selected from the group consisting of hydrogen, phenyl groups, and linear, branched, and cyclic alkyl, alkenyl, and alkynyl groups having between about 1–6 carbon atoms. In a preferred embodiment, n is 1 and $R^1$ and $R^2$ independently are selected from the group consisting of phenyl groups and linear, branched, and cyclic alkyl, alkenyl, and alkynyl groups having between about 1–3 carbon atoms. A most preferred embodiment is 3,3'-methylenebis-[S-methyl oxazolidine], in which n is 1 and $R^1$ and $R^2$ are methyl groups.

While specific examples of $R^1$ and $R^2$ have been described, $R^1$ and $R^2$ may be any substituent that does not substantially interfere with the solubility of the bisoxazolidine in the hydrocarbon substrate. Materials with equivalent properties should include products of the reaction of 1,2 or 1,3 amino alcohols containing 3–7 carbon atoms with aldehydes containing 4 or fewer carbon atoms. A substituent "substantially interferes" with the solubility of the bisoxazolidine if the bisoxazolidine cannot be rendered readily soluble in the substrate with the use of an acceptable cosolvent. In this regard, when $R^1$ and $R^2$ are hydrogen, a cosolvent may be required to maintain the solubility of the bisoxazolidine. A preferred cosolvent in such instance comprises between about 10–50% BUTYLCELLOSOLVE™, a monobutylether of ethylene glycol available from Union Carbide, and between about 50–90% FINASOL™, available from Fina Oil & Chemical Co., Dallas, Tex.

The bisoxazolidines of the present invention exhibit a high uptake capacity for hydrogen sulfide, and the raw materials required to manufacture the bisoxazolidines are low cost materials. Bisoxazolidines may be made by reacting an alkanolamine with between about 1.1 to 2.1 equivalents, preferably 1.5 equivalents, of paraformaldehyde to yield an aqueous solution of reaction products. In a preferred embodiment, monoisopropanolamine (MIPA) is reacted with paraformaldehyde to form an aqueous mixture which, after distillation, yields substantially water free 3,3'-methylenebis[5-methyloxazolidine]. The water formed by the reaction preferably should be removed by distillation, preferably after the reaction is complete, to give a substantially water free bisoxazolidine. In this preferred embodiment, the reaction takes place at ambient pressure and at a temperature of between about 100–200° C. (212–392° F.). Preferably, the resulting bisoxazolidine should contain less than about 20% water, most preferably less than about 5% water.

Bisoxazolidines are commercially available in Europe as preservatives for oil base paints and fuel oils. An example of such a product is GROAN-OX™, which is commercially available from Sterling Industrial, UK. The bisoxazolidine preferably should be added to the hydrocarbon substrate at a high enough temperature that the substrate is flowable for ease in mixing. The treatment may take place at temperatures up to the temperature at which the material being treated begins to decompose. Preferred treatment temperatures are between ambient to about 200° C. (392° F.).

The hydrocarbon or aqueous substrate should be treated with the bisoxazolidine until reaction with hydrogen sulfide, or with other sulfhydryl compounds, has produced a product in which the sulfhydryls in the vapor (or liquid) phase have been removed to an acceptable or specification grade product. Typically, a sufficient amount of bisoxazolidine should be added to reduce the sulfhydryls in the vapor phase to at least about 200 ppm or less.

In order to determine how much bisoxazolidine to add to a given substrate, the amount of $H_2S$ in the vapor phase above the hydrocarbon may be measured. The bisoxazolidine may be added to the hydrocarbon in an amount equal to about ⅔–1 ppm by weight of scavenger per 10 ppm by volume of $H_2S$ concentration in the vapor phase. Alternately, the total concentration of hydrogen sulfide in the system can be measured, and a molar ratio of between about ⅓–⅔ mole of bisoxazolidine to 1 mole of hydrogen sulfide in the system may be added. The molar amount of bisoxazolidine added as a scavenger should be proportional to the molar amount of sulfhydryl compound(s) present in the substrate and will depend on the level of sulfhydryl reduction required. Hydrogen sulfide contents of up to about 100,000 ppm in the vapor phase may be treated satisfactorily with the bisoxazolidines of the present invention. The bisoxazolidines will be most effective if the substrate is treated at temperatures between ambient to about 200° C. (392° F.).

The invention will be better understood with reference to the following examples:

EXAMPLE 1

In a liter flask was placed 600 gm of monoisopropanolamine (MIPA). The MIPA was stirred and cooled in a water bath. Paraformaldehyde was added in three equal portions. During the first two additions, the pot temperature reached a maximum of about 95° C. (203° F.). The second and third portions of paraformaldehyde were added after the mixture had cooled to about 65° C. (149° F.). After the third portion of paraformaldehyde was added, the mixture was warmed and kept at 95° C. (203° F.) until all of the paraformaldehyde had dissolved. The mixture was gradually warmed to 140° C. (284° F.) and about 242 gm of distillate were collected. The material remaining in the flask was determined to be essentially pure 3,3'-methylenebis-[5-methyloxazolidine].

EXAMPLE 2

The following basic protocol was used for each of Examples 2–3:

Septum bottles were half filled with hydrogen sulfide laden marine or No. 6 fuel oil from a Louisiana refinery. The head spaces were blanketed with nitrogen. The bottles were septum sealed and placed in an oven at 65° C. (149° F.). After 18 hours, samples were shaken and the head spaces were analyzed for hydrogen sulfide by withdrawing a known volume from the head space with a gas-tight syringe. The sample (or a dilution of the sample in air) was injected into a gas chromatograph (GC) and the area counts of hydrogen sulfide measured. The results were noted as the initial vapor phase hydrogen sulfide concentration for comparison to final readings.

A known amount of the candidate and comparative materials were injected into all of the sample bottles except controls. The control bottles were designated blanks (i.e., untreated). The bottles were shaken vigorously for 30 seconds to mix the additives into the oil, and placed in an oven at 65.5° C. (150° F.). The bottles were shaken periodically, and samples of the head space vapor were withdrawn using a gas tight $\mu$L syringe at various intervals. The samples were analyzed by gas chromatography. If the measured amount of vapor phase hydrogen sulfide was not significantly abated, the process was repeated after additional incremental injections of candidate.

The hydrogen sulfide content of the head space in the samples and the control was calculated by comparing the area counts with a standard curve for hydrogen sulfide. The results are shown in the respective Figures.

The efficacy of a candidate may be expressed as the treatment effectiveness ratio ("TER"). The TER is defined as $$\frac{PPM_v \text{ of vapor } H_2S \text{ abated}}{PPM_w \text{ of candidate added}}$$

The higher the value of "TER," the greater the efficacy.

For purposes of this experiment, several products commercially available for the same purpose (designated "A" and "B") were compared with samples internally designated "RE-3019" and "RE-3175", which contain 3,3'-methylene bis-[5-methyl oxazolidine] and a mixture of reaction products, a major proportion of which comprises 3,3'-methylene bisoxazolidine, respectively. The objective was to produce a series of dosage response curves for the additives.

The oil was dosed to a level of 18,000 ppm $H_2S$ and dispensed into the serum bottles. The bottles were allowed to equilibrate for approximately 2 days. Initial vapor space hydrogen sulfide concentrations in the serum bottles averaged between 92,000–100,000 ppm-v. The results are given in FIG. 1, and charted in FIG. 2.

FIG. 1 shows the results for the additives two hours after the first injection of 1500 ppm-w of candidate. The samples were allowed additional reaction time overnight. The vertical drop line in FIG. 1 shows the additional amount of hydrogen sulfide abated after 16.5 hours at 1500 ppm-w of each additive. Finally, FIG. 1 displays the results 3.5 hours following the second dosage injection totaling 3500 ppm-w of each additive. The two experimental additives, RE-3019 and RE-3175, reduced hydrogen sulfide to nearly zero. For chart clarity, the test results for the replicate run of RE-3175 were not included. The replicate results mirrored the results for the original RE-3175 sample.

EXAMPLE 3

The commercial candidates again were compared with RE-3019 and RE-3175. The commercial candidates were tested in their "as sold" concentrations; RE-3019 was tested as a 100% concentrate; and, RE-3179 was tested as 80% active gel dispersed in xylene. The reaction times for all of the samples was slower than expected, but uniformly so for an undetermined reason.

The results are given in FIG. 3. Both RE-3019 and RE-3179 had a very high TER—from 8 to 5 times higher than the commercial candidates.

Persons of ordinary skill in the art will appreciate that many modifications may be made to the embodiments described herein without departing from the spirit of the present invention. Accordingly, the embodiments described herein are illustrative only and are not intended to limit the scope of the present invention.

I claim:

1. A method for scavenging sulfhydryl compounds from a substantially water free hydrocarbon substrate comprising a sulfhydryl content, said method comprising:

reacting an alkanolamine with a paraformaldehyde to form a condensation product comprising a water content and a sulfhydryl scavenging compound having the following general structure:

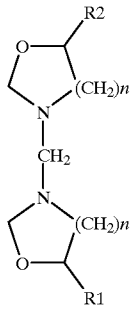

wherein n is from about 1 to about 2, $R^1$ and $R^2$ independently are selected from the group consisting of hydrogen, phenyl groups, and linear, branched, or cyclic alkyl, alkenyl, and alkynyl groups having from about 1 to about 6 carbon atoms, treating said condensation product to reduce said water content, producing sulfhydryl scavenging agent comprising about 5% water or less; and mixing said substrate with an amount of said sulfhydryl scavenging agent effective to reduce said sulfhydryl content of said substrate.

2. The method of claim 1 wherein n is 1; and said sulfhydryl scavenging compound comprises a bisoxazolidine.

3. The method of claim 1 wherein said substrate is selected from the group consisting of crude oil, refined distillate streams, and natural gas.

4. The method of claim 1 wherein said substrate is selected from the group consisting of crude oil, refined distillate streams, and natural gas.

5. A method for scavenging sulfhydryl compounds from a substantially water free hydrocarbon substrate comprising a sulfhydryl content, said method comprising:

reacting an alkanolamine with a paraformaldehyde to form a condensation product comprising a water content and a sulfhydryl scavenging compound having the following general structure:

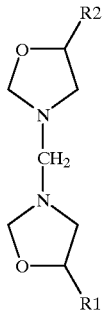

wherein $R^1$ and $R^2$ independently are selected from the group consisting of hydrogen, phenyl groups, and linear, branched, or cyclic alkyl, alkenyl, and alkynyl groups having from about 1 to about 6 carbon atoms;

treating said condensation product to reduce said water content, producing a sulfhydryl scavenging agent comprising about 5% water or less; and mixing said substrate with an amount of said sulfhydryl scavenging agent effective to reduce said sulfhydryl content of said substrate.

6. The method of claim 5 wherein said linear, branched, and cyclic alkyl, alkenyl, and alkynyl groups comprise between about 1–3 carbon atoms.

7. The method of claim 5 wherein $R^1$ and $R^2$ are methyl groups.

8. The method of claim 5 wherein said substrate is selected from the group consisting of crude oil, refined distillate streams, and natural gas.

9. The method of claim 6 wherein said substrate is selected from the group consisting of crude oil, refined distillate streams, and natural gas.

10. The method of claim 7 wherein said substrate is selected from the group consisting of crude oil, refined distillate streams, and natural gas.

11. The method of claim 5 wherein said substrate is selected from the group consisting of crude oil, refined distillate streams, and natural gas.

12. A method for scavenging sulfhydryl compounds from a substantially water free hydrocarbon substrate comprising a sulfhydryl content, said method comprising:

reacting an alkanolamine with an aldehyde to form a condensation product comprising a water content and a sulfhydryl scavenging compound comprising an N—C—N moeity;

treating said condensation product to reduce said first water content, producing a sulfhydryl scavenging agent comprising about 5% water or less; and mixing said substrate with an amount of said sulfhydryl scavenging agent effective to reduce sa id sulfhydryl content.

13. The method of claim 12 wherein said substrate is selected from the group consisting of crude oil, refined distillate streams, and natural gas.

14. The method of claim 12 wherein said treating said condensation product comprises removing water from said condensation product by distillation.

15. The method of claim 12 further comprising forming said condensation product by reacting an amino alcohol with an aldehyde comprising in the range of from about 1 to about 4 carbon atoms.

16. The method of claim 14 further comprising forming said condensation product by reacting an amino alcohol with an aldehyde comprising in the range of from about 1 to about 4 carbon atoms.

17. The method of claim 15 wherein said amino alcohol comprises in the range of from about 3 to about 7 carbon atoms and is selected from the group consisting of a 1,2-amino alcohol and a 1,3-amino alcohol.

18. The method of claim 16 wherein said amino alcohol comprises in the range of from about 3 to about 7 carbon atoms and is selected from the group consisting of a 1,2-amino alcohol and a 1,3-amino alcohol.

* * * * *